US005238425A

United States Patent [19]

Kliewer

[11] Patent Number: 5,238,425

[45] Date of Patent: Aug. 24, 1993

[54] MOUNTING APPARATUS

[76] Inventor: Wesley P. Kliewer, 712 Dickran Dr., Tulare, Calif. 93275

[21] Appl. No.: 591,089

[22] Filed: Oct. 1, 1990

[51] Int. Cl.[5] ..... H01R 13/60

[52] U.S. Cl. ..... 439/541; 248/216.1; 362/249

[58] Field of Search ..... 439/527, 502, 419, 571, 439/573, 414, 541; 248/71, 216.1; 362/249, 250, 806

[56] References Cited

U.S. PATENT DOCUMENTS

| | | | |
|---|---|---|---|
| 2,527,442 | 10/1950 | Odegaard | 248/71 X |
| 2,864,070 | 12/1958 | Abramson | 439/414 X |
| 2,889,451 | 6/1959 | Longo . | |
| 3,479,636 | 11/1969 | McBride . | |
| 3,529,796 | 9/1970 | MacDonald | 248/71 |
| 3,872,971 | 3/1975 | Dinsmore, Jr. et al. . | |
| 4,093,333 | 6/1978 | Tjornhom, Sr. . | |
| 4,128,863 | 12/1978 | Premetz | 362/806 X |
| 4,830,626 | 5/1989 | Liu . | |
| 4,901,212 | 2/1990 | prickett | 362/806 X |
| 4,985,001 | 1/1991 | Nagai | 439/527 |

FOREIGN PATENT DOCUMENTS

| | | | |
|---|---|---|---|
| 0007260 | of 1902 | United Kingdom | 439/419 |
| 0341265 | 1/1931 | United Kingdom | 439/419 |
| 0412939 | 7/1934 | United Kingdom | 439/419 |
| 0440836 | 1/1936 | United Kingdom | 439/419 |

*Primary Examiner*—Eugene F. Desmond
*Attorney, Agent, or Firm*—Worrel & Worrel

[57] ABSTRACT

An apparatus for mounting a first work object on a second work object, the apparatus having a fastening assembly including a first element adapted to be secured on the second work object in substantially fixed relation; a second element mounted on the first work object; and structure operable to interconnect the first and second elements for supporting the second element on the first element in a substantially fixed attitude and thus the first work object in a substantially fixed attitude relative to the second work object.

6 Claims, 2 Drawing Sheets

MOUNTING APPARATUS

BACKGROUND OF THE INVENTION

1. Field of the Invention:

The present invention relates to a mounting apparatus and more particularly to such a mounting apparatus which is adapted conveniently to permit the installation of a first work object on a second work object in a precisely controlled attitude relative thereto in such a fashion as to permit convenient removal of the first work object from the second work object and, subsequently, reinstallation of the first work object on the second work object in the same precisely controlled attitude relative thereto and further to such a mounting apparatus having particular utility in the installation of ornamental light assemblies wherein a multiplicity of light bulbs must be precisely positioned as to location and as to attitude relative to a work object.

2. Description of the Prior Art:

There are a host of circumstances in which a first work object must be mounted on a second work object not only in a selected position but also retained in a specific precise attitude relative to the second work object which is to be maintained throughout the usage thereof. One such environment is that of installing ornamental lighting assemblies or systems, such as Christmas lights, on the facia immediately beneath the eaves of a structure. Thus, in the case of Christmas lights, it is traditional during the Christmas season to install strands of brightly colored lights along, or immediately beneath, the eaves of homes and businesses as well as in other locations to celebrate the holiday season. Such ornamental lighting assemblies are widely used and are marketed at relatively minimal cost in large volumes throughout the holiday season.

Conventionally, Christmas lighting assemblies employ a lengthy power cable on which are mounted a plurality of socket housings individually mounting light bulbs of different colors. Each of the socket housings characteristically has a clip, hook or clasp extended from one side thereof through which a nail or similar fastener is adapted to be driven into the facia to retain the socket housing in the position selected. Unfortunately, there are a multiplicity of problems inherent in the installation and usage of such Christmas lighting assemblies which substantially detract from the pleasure otherwise associated with their use and, for the person installing them, often prove to be exceedingly annoying, if not infuriating.

Characteristically, such Christmas lighting assemblies are packaged in boxes in which the power cable is coiled into a tightly wound configuration which causes the power cable to become twisted. This causes the socket housings and light bulbs thereof to become twisted from the desired substantially coplanar relation. Such deformation inevitably results in a number of the socket housings being twisted 180° or 360° from the desired coplanar relation thereby positioning the socket housing either in an inverted condition or in a condition in which the clasp or clip of the socket housing is on the wrong side of the housing for installation on the facia or other desired location. This condition requires either a tedious and not entirely reliable process of untwisting the power cable in advance of installation of the Christmas lighting assembly, or the haphazard installation of the socket housings using the fasteners in other than the prescribed arrangement and often requiring that certain of the socket housing simply be left unattached to the facia suspended on the power cable between those socket housings which are fastened on the facia.

Any attempt at reuse of such Christmas lightening assemblies in subsequent seasons results in an aggravation of the problems heretofore noted. The power cable becomes hardened and less tractable with time, the clips or other fasteners are damaged or lost and the tedious untwisting of the power cable causes the electrical conductors ultimately to fragment and short out thereby completely destroying the Christmas lighting assembly. Still another problem faced in subsequent attempts at installation of conventional Christmas lighting assemblies results from the fact that the installation must be performed in total each season; that is, the nails, screws or the like driven into the facia the previous year must be removed, and new fasteners reinstalled during the installation process.

Therefore, it has long been known that it would be desirable to have a mounting apparatus having application to the mounting of a first work object on a second work object in a precise desired position and attitude which is capable of convenient removal and reuse when desired and which has particular utility in the installation, removal and reinstallation of ornamental lighting assemblies such as Christmas lighting assemblies without the chronic problems heretofore associated therewith.

SUMMARY OF THE INVENTION

Therefore, it is an object of the present invention to provide an improved mounting apparatus operable to permit the installation of a first work object on a second work object in the precise position and attitude desired.

Another object is to provide such a mounting apparatus which can be employed rapidly and precisely to achieve such installation initially and which thereafter permits removal of the first work object conveniently from the second work object and, if desired, the reinstallation of the first work object on the second work object without the use of any tools whatsoever after the initial installation.

Another object is to provide such a mounting apparatus which has particular utility when used as an integral part of ornamental lighting assemblies having a power cable along which are successively mounted a plurality of socket housings individually mounting light bulbs permitting each of the socket housings to be mounted in the precise position desired with the light bulb suspended therefrom in the precise attitude desired requiring only the use of a hammer for the initial installation and which permits the removal of the ornamental lighting assembly or subsequent storage and ultimate reuse.

Another object is to provide such a mounting apparatus which permits ornamental lighting assemblies to be reused in successive seasons using the same fasteners and without requiring any tools whatsoever.

Another object is to provide such a mounting apparatus which permits ornamental lighting assemblies to be used substantially in the form it is in once uncoiled without requiring the tedious twisting of the power cable which is required in conventional ornamental lighting assemblies.

Another object is to provide such a mounting apparatus which employs fasteners which are virtually invisible when not in use but remain available for reinstallation of the ornamental lighting assembly when desired.

Another object is to provide such a mounting apparatus which precludes a risk that a fastener may be driven through an electrical conductive portion thereof in such a fashion as to create a fire or other hazard.

Another object is to provide such a mounting apparatus which is so designed as to permit the interoperable parts thereof to be conveniently and precisely positioned relative to each other with little attention to detail.

Further objects and advantages are to provide improved elements and arrangements thereof in an apparatus for the purpose described which is dependable, economical, durable and fully effective in accomplishing its intended purpose.

These and other objects and advantages are achieved, and the preferred embodiment of the present invention, in an apparatus for mounting a first work object on a second work object having a fastening assembly including a first element adapted to be secured on the second work object in substantially fixed relation; a second element mounted on the first work object and a structure adapted to interconnect the first and second elements for supporting the second element on the first element in a substantially fixed attitude and thus the first work object in a substantially fixed attitude relative to the second work object.

DESCRIPTION OF THE PREFERRED EMBODIMENT

Figure 1:
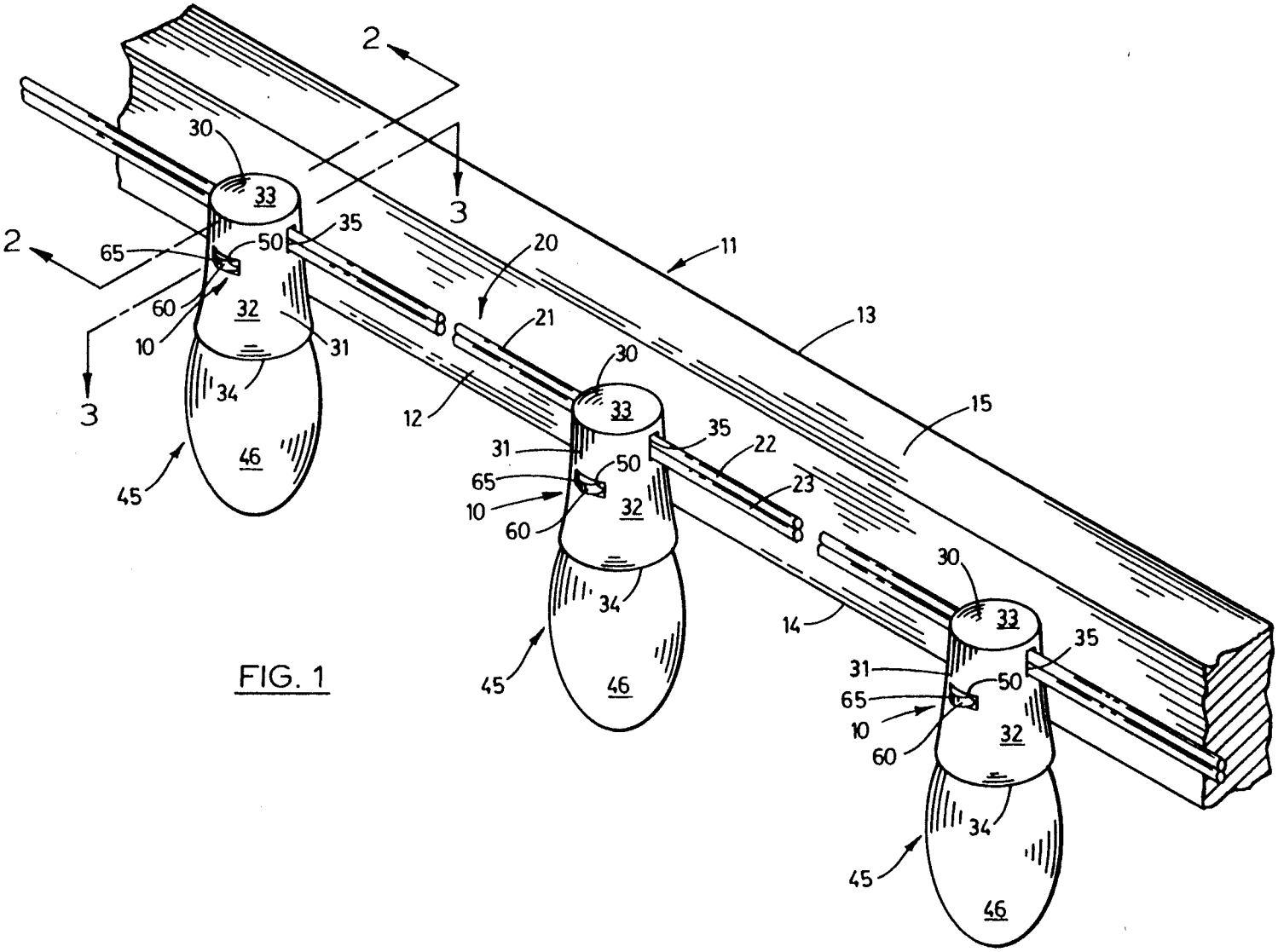
FIG. 1 is a fragmentary perspective view of the mounting apparatus of the present invention employed as an integral part of an ornamental lighting assembly including a plurality of such mounting apparatuses mounted in a typical operative environment.

Referring more particularly to the drawings, the mounting apparatus of the present invention is generally indicated by the numeral 10 in FIG. 1. In the preferred embodiment, the mounting apparatus is employed as an integral part of a Christmas or ornamental light assembly hereinafter to be described in greater detail. However, as will become more clearly apparent, the mounting apparatus has application to a wide variety of embodiments and environments of use and is not to be limited in any fashion to the details of the preferred embodiment shown and described herein.

Nonetheless, the mounting apparatus is excellently suited to usage in the disclosed preferred embodiment. In this operative environment, the mounting apparatus is employed in conjunction with a second work object or facia 11, such as that of a home, business, or other structure, immediately beneath the eaves of the structure. The facia has a substantially flat forward surface 12 and an opposite substantially parallel rearward surface 13. The facia has a lower surface 14 and an opposite upper surface 15.

The ornamental light assembly is generally indicated by the numeral 20 in FIG. 1. The ornamental light assembly, in this case a Christmas light assembly, incorporates a plurality of the mounting apparatuses 10 which are mounted, as will hereinafter be described, on a power cable 21 shown fragmentarily in FIG. 1. In the conventional fashion, the power cable 21 is adapted for connection to a source of electrical energy, not shown. The power cable includes a first conductor 22 and a parallel second conductor 23. Each conductor is composed of an internal electrically conductive wire 24 surrounded by encapsulating insulation 25.

As previously noted, the mounting apparatus 10 is adapted for use as an integral part of the ornamental light system 20 and one mounting apparatus is employed for each light bulb constituting part of the ornamental light assembly. Since each of the mounting apparatuses is substantially identical, only one such mounting apparatus will be described herein. The mounting apparatus includes a light socket assembly 30 including a dielectric socket housing 30 having a substantially cylindrical outer surface 32. The socket housing has an upper surface 33 and an opposite lower surface 34. A cable passage 35 extends through the socket housing adjacent and substantially parallel to the upper surface 33 thereof. An internally screw threaded socket 36 extends inwardly of the socket housing through the lower surface 34 thereof. The internally screw threaded socket has an internal electrical contact 37.

A light bulb 45 is adapted to be mounted in the internally screw thread socket 36 of the socket housing 31. The light bulb has a bulb portion 46 and an opposite externally screw threaded base portion 47. The base portion has an electrical contact 48 adapted to contact the electrical contact 37 of the socket housing 31 when the base portion of the light bulb is screw-threadably secured in the internally screw threaded socket 36.

It will be understood that the first conductor 22 and second conductor 23 of the power cable 21 are operably connected to the electrical contact 37 by any suitable conventional means well known in the art.

Figure 2:
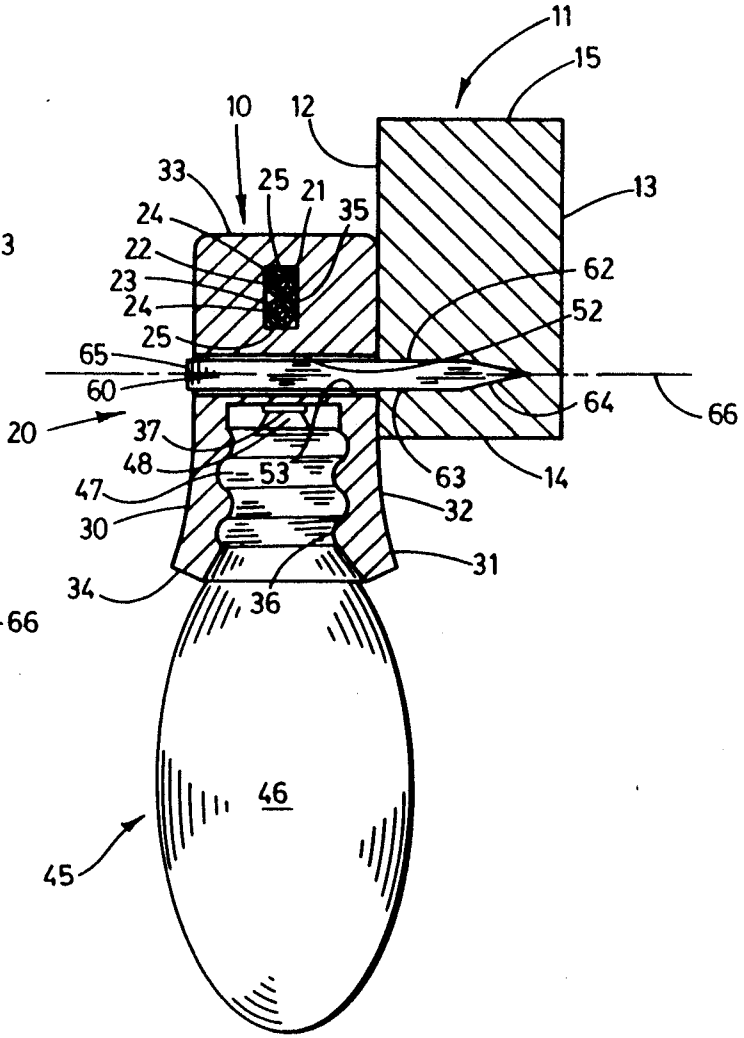
FIG. 2 is a somewhat enlarged transverse, vertical section taken on line 2—2 in FIG. 1.

The mounting apparatus 10 includes a transverse passage 50 extending transversely through the socket housing 31 between the cable passage 35 and the electrical contact 37, as best shown in FIG. 2. The passage extends through the socket housing in such a fashion as to be in contact with only the dielectric portion of the socket housing. The passage is of substantially rectangular configuration in cross section having a pair of opposite side surfaces 51, an upper surface 52 and an opposite substantially parallel lower surface 53. The passage communicates with exterior of the socket housing through tapered or flared mouth portions 54, best shown in FIG. 3.

Each of the mounting apparatuses 10 includes a pin or fastener 60 preferably constructed of metal. The fastener has side surfaces 61, an upper surface 62 and an opposite lower surface 63. The fastener is thus substantially rectangular in cross section. The fastener has a pointed proximal portion 64 and an opposite rounded distal portion 65. The fastener is elongated along a longitudinal axis 66 shown in FIGS. 2 and 3.

OPERATION

The operation of the described embodiment of the subject invention is believed to be clearly apparent and is briefly summarized at this point. As will subsequently become more clearly apparent, the ornamental light assembly 20 incorporating the mounting apparatus 10 of the present invention need only be installed once for it to be capable of being removed and subsequently reinstalled without the procedures required for the initial installation.

The initial installation of the ornamental light assembly 20 requires only that the light assembly be extended along the facia 11 so as to position the light bulbs 45 in the positions desired and the power cable connectible to the source of electrical energy, not shown. Such installation maybe involve marking of the facia to note the positions at which to drive the fasteners 60 into position for mounting of the light bulbs 45. However, this is not required in that the very process of installing the ornamental light assembly can be employed to precisely position the light bulbs. This is achieved simply by beginning with the first or last of the light bulbs of the ornamental light assembly and installing it in the position desired. Thereafter, each of the light socket assemblies 30 can be installed consecutively so as to cover the facia 11 as desired.

For example, where the first light socket assembly 30 is to be installed first, the power cable 21 is first so positioned as to be connectible to the source of electrical energy, not shown. Thereafter, the operator simply holds the first light socket assembly in the desired position with the passage 50 thereof disposed at right angles to the forward surface 12 of the facia. Holding the light socket assembly 30 in the selected position, the fastener 60 is inserted through the passage 50 pointed proximal portion 64 first until the proximal portion engages the forward surface 12 of the facia. Thereafter, using a hammer, the installer drives the fastener into the passage using the hammer to cause the pointed proximal portion to penetrate the facia. The fastener is driven until it is disposed substantially in the position shown in FIGS. 2 and 3. As can be seen, this automatically disposes the longitudinal axis 66 of the fastener substantially at right angles to the forward surface 12 of the facia. The first light socket assembly 30 has thus been installed without further effort required. This process is repeated with each successive light socket assembly until all of the light socket assemblies of the ornamental light assembly 20 have been installed in the desired positions on the facia. Thereafter, the ornamental light assembly 20 is operated in the conventional fashion by supplying electrical energy thereto by plugging the end, not shown, of the power cable into the source of electrical energy to illuminate the bulb portions 46 of the light bulbs for the purposes desired.

Where, for example, the ornamental light assembly 20 is employed as Christmas lights, they are conventionally removed at the end of the holiday season. This is achieved with the mounting apparatus of the present invention simply by pulling each of the light socket assemblies 30 from its respective fastener 60 leaving the fasteners in the installed position. The ornamental light assembly is then stored in the conventional fashion for the next holiday season. Since the fasteners are substantially flat and protrude from the facia only a distance as required by the width of the light socket assembly 30, they are virtually invisible when not in use.

Figure 3:
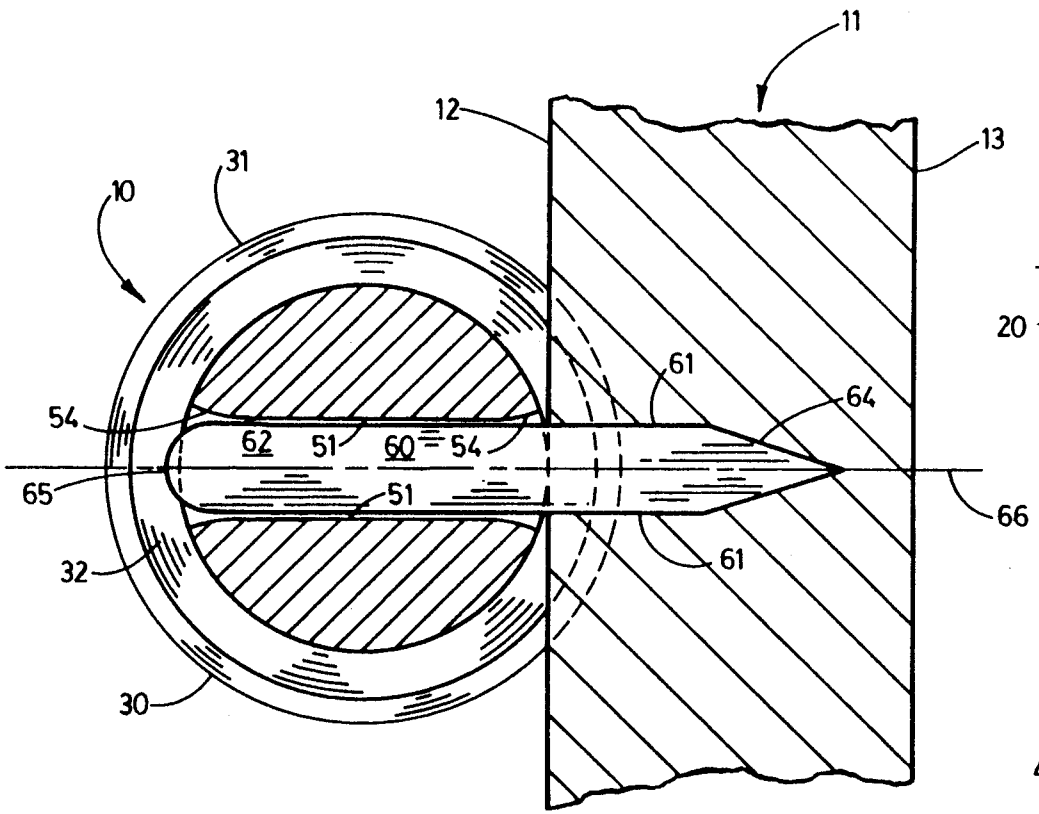
FIG. 3 is a somewhat further enlarged fragmentary, horizontal section taken on line 3—3 in FIG. 1.

When the next holiday season arrives and it is desired to use the ornamental light assembly 20, it is installed simply by again sliding each successive light socket assembly 30 about its respective fastener 60 with the fastener received in the passage 50 thereof as best shown in FIGS. 2 and 3. Since, as can be seen in FIG. 3, the passage has opposite flared mouth portions 54, twisting of the power cable 21 as conventionally occurs due to storage in a coiled configuration does not in any respect interfere with installation of each light socket assembly on its respective fastener. Thus, even if the power cable is twisted, the socket housing 31 can be positioned on its respective fastener by insertion from either flared mouth portion 54. Similarly, since the configurations of the passage 50 and the fastener 60 are substantially rectangular and dimensioned for fitted engagement, such slidable installation of each socket housing operates automatically precisely to position each socket housing in the precise desired position initially selected therefor. Still further, only a hammer is required for initial installation of the mounting apparatus and no tools are required for installation of the ornamental light assembly 20 after the initial installation as heretofore described.

Therefore, the mounting apparatus of the present invention is operable to permit the installation of ornamental light assemblies and the like in precisely supported relation by a single initial installation which insures that each of the light bulbs borne thereby is precisely positioned as desired by the installer and is retained in that position not only through the initial period of use thereof, but thereafter during subsequent periods for as long as the ornamental light assembly is operable requiring in each subsequent installation only the slidable positioning of each mounting apparatus in the initially selected position all in a device which is fully compatible with conventional ornamental light assemblies.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A mounting apparatus adapted for use in mounting Christmas lights on a means of support, the apparatus comprising a housing having at least one passage extending therethrough and an electrical socket adapted to receive a light bulb in installed relation therein for connection to a source of electrical energy; a mounting member dimensioned slidably to be received in the passage whereby the housing can be installed on the means of support by holding the housing in the desired position relative to said means of support and the mounting member driven through the passage into the means of support to retain the housing in said desired position on the means of support; and means for resisting movement of the housing about the member when the member is in said passage.

2. An apparatus for mounting a first work object on a second work object, the apparatus comprising a fastening assembly including a substantially flat pin having a longitudinal axis, a pointed end portion, adapted to be driven into the second work object in substantially fixed relation so that said longitudinal axis is substantially normal to the second work object, and an opposite end portion; an element mounted on the first work object; and means adapted to interconnect the pin and the element including a passage substantially rectangular in cross section dimensioned for substantially fitted receipt of the pin therewithin with said opposite end portion of the pin dimensioned to pass through said passage wherein said passage extends entirely through the element and the passage has entrance openings at both ends thereof which are tapered inwardly to assist in guiding said pin inwardly and conversely outwardly of the passage whereby the pin can be left in the second work object and the first work object removed from the second work object by removing the element from about said pin and, subsequently, the first work object again mounted on the second work object by sliding the element about the pin with the pin received in said passage.

3. The apparatus of claim 2 wherein said opposite end portion of the pin is rounded to assist in again mounting said first work object on the second work object by guiding said pin inwardly of the passage.

4. A mounting apparatus adapted for use in removably mounting Christmas lights on a work object, the apparatus including a fastening assembly for said Christmas lights comprising:

A. a dielectric housing having an electrical socket adapted to receive a light bulb in installed relation therein, an electrical system, connected to a source of electrical energy, operable to supply electrical energy to a light bulb received in said socket and a passage of angular cross section extending through said housing in isolation from the electrical system thereof; and B. a pin having a longitudinal axis, a transverse dimension substantially conforming to said passage of the housing and an end portion adapted to be mounted on said work object extending outwardly therefrom for slidable receipt of the housing about said pin with the pin received in the passage to prevent rotation of the housing about said longitudinal axis of the pin.

5. The mounting apparatus of claim 4 wherein said pin and the passage of the housing are substantially rectangular in cross section.

6. An apparatus for mounting a light source on a means of support the apparatus comprising a fastening assembly including a member having a longitudinal axis, adapted to be driven into the means of support, an opposite end portion and having a predetermined cross sectional configuration; an element mounted on the light source; and means for interconnecting the element and the member including a passage extending through said element dimensioned for substantially slidable receipt of the member therewithin and said interconnecting means establishing contact with the member within the passage resistant to rotation of the element, and thereby the light source, about said longitudinal axis of the member.

* * * * *